US006833676B2

(12) United States Patent
Brumleve

(10) Patent No.: US 6,833,676 B2
(45) Date of Patent: Dec. 21, 2004

(54) SOLID LAMP FILL MATERIAL AND METHOD OF DOSING HID LAMPS

(75) Inventor: Timothy R. Brumleve, Urbana, IL (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 10/682,932

(22) Filed: Oct. 14, 2003

(65) Prior Publication Data

US 2004/0124777 A1 Jul. 1, 2004

Related U.S. Application Data

(62) Division of application No. 09/801,653, filed on Mar. 9, 2001, now Pat. No. 6,661,175.

(60) Provisional application No. 60/188,004, filed on Mar. 9, 2000.

(51) Int. Cl.[7] ..... H01J 17/20; H01J 61/18; H01J 61/20

(52) U.S. Cl. ..... 313/638; 313/490; 313/639

(58) Field of Search ..... 313/490, 638, 313/639, 640, 641, 642, 643, 553, 557; 417/48, 49, 50, 51; 445/38

(56) References Cited

U.S. PATENT DOCUMENTS 4,386,050 A * 5/1983 Anderson ..... 313/639
5,212,424 A * 5/1993 Russell et al. ..... 313/642
5,504,392 A * 4/1996 Natour et al. ..... 313/642

* cited by examiner

*Primary Examiner*—Ashok Patel
*Assistant Examiner*—Sharlene Leurig
(74) *Attorney, Agent, or Firm*—Duane Morris LLP

(57) ABSTRACT

A solid halogen-containing lamp fill material and a method of introducing small amounts of halogen into a HID lamp are disclosed. The solid material may include an admixture of a metal and a metal halide in the form of spheres of high purity, uniform size and uniform composition. Solid lamp fill material and methods of introducing small quantities of one or more metals into a HID lamp are also disclosed.

7 Claims, 2 Drawing Sheets

SOLID LAMP FILL MATERIAL AND METHOD OF DOSING HID LAMPS

CLAIM OF PRIORITY

This Application is a divisional of and claims benefit of application Ser. No. 09/801,653 filed Mar. 9, 2001 now U.S. Pat. No. 6,661,175 entitled "SOLID LAMP FILL MATERIAL AND METHOD OF DOSING HID LAMPS", which claims the benefit of U.S. Provisional Patent Application Ser. No. 60/188,004, filed Mar. 9, 2000.

BACKGROUND OF THE INVENTION

The present invention relates generally to dosing lamp fill material in lamps. More specifically, the present invention relates to dosing small quantities of halogens in high intensity discharge ("HID") lamps.

HID lamps with a vaporizable lamp fill have found widespread use in lighting large outdoor and indoor areas such as athletic stadiums, gymnasiums, warehouses, parking facilities, and the like, because of the relatively high efficiency, compact size, and low maintenance of HID lamps when compared to other lamp types. HID lamps have also been developed as point sources. In many applications, it is advantageous to lamp operation to provide a small amount of a halogen in the arc tube of HID lamps. In other applications, it may be advantageous to provide a small quantity of one or more metals in the arc tube of HID lamps.

For example, ultra high pressure mercury lamps operate with mercury pressures of 100 atmospheres and higher and have been found to be good point sources for projection and optical systems. One disadvantage of such lamps is a reduced operating life resulting from the blackening of the walls of the arc tube due to deposition of tungsten from the lamp electrodes on the arc tube wall. It is known that small quantities of a halogen dosed into the arc tube of the lamp reduces the blackening of the wall of the arc tube and thus extends the life of the lamp. Typically, chlorine, bromine, or iodine is dosed into ultra high pressure mercury lamps, however, bromine has been favored in most applications. The quantity of halogen dosed in these lamps is typically less than 0.1 mg and may be less than 0.1 $\mu$g. For example, U.S. Pat. No. 5,497,049 to Fischer discloses an ultra high pressure mercury lamp having a dose of bromine of less than 0.1 $\mu$g.

There remains the practical question of how to dose such small quantities of a halogen into the arc tube of a HID lamp. One known method is to add an appropriate quantity of halogen gas to the inert fill gas of the lamp. In the example of providing bromine in an ultra high pressure mercury lamp, the bromine in the form of $Br_2$ may be added to the argon fill gas. However, it is difficult to control the $Br_2$ concentration in the fill gas and the $Br_2$ may be absorbed on the surfaces of the gas delivery system gas or react with system components. Thus precise small quantities of bromine are difficult to dose into lamps using this method.

Another known method of dosing such small quantities of bromine in a HID lamp includes adding methylene bromide ($CH_2Br_2$) vapor to the argon fill gas of the lamp as disclosed in U.S. Pat. No. 5,109,181 to Fischer et al. However, it is difficult to control the concentration of the vapor in argon in this method. Further, hydrogen contamination in the lamp is possible.

Yet another known approach to dosing such small quantities of bromine into a lamp includes the formation of lamp fill particles formed from mercuric bromide ($HgBr_2$).

However, it is very difficult to fabricate and handle a sphere having quantities of halide as low as 0.1 $\mu$g. Even larger spheres having as much as 0.05 mg of halide are difficult to dose into lamps because of the small size of the spheres. The spheres are also difficult to handle and dose because of static electricity.

Thus there remains a need for a method of dosing small quantities of a halogen in a HID lamp in an easily fabricated and dosed lamp fill material.

Accordingly, it is an object of the present invention to obviate the deficiencies of the known prior art and to provide a novel lamp fill material.

It is another object of the present invention to provide a novel particle suitable for introducing small quantities of a halogen into a HID lamp.

It is yet another object of the present invention to obviate the deficiencies of the known prior art and to provide a novel method of dosing a lamp.

It is still another object of the present invention to provide a novel method of dosing a HID lamp with small quantities of a halogen in a solid lamp fill particle.

It is a further object of the present invention to provide a method of dosing a lamp which reduces the introduction of impurities into the lamp.

It is yet a further object of the present invention to provide a novel lamp fill material for introducing a metal and metal halide into a HID lamp.

It is still a further object of the present invention to provide a novel method of dosing a HID lamp with small quantities of one or more metals and a metal halide.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

The present invention finds utility in dosing the desired quantities of a metal halide and metal in all types and sizes of HID lamps. By way of example only, certain aspects of the present invention may be easily understood in the embodiment of a vaporizable lamp fill material and method of dosing small quantities of bromine in ultra high pressure mercury lamps.

It has been discovered that lamp fill material suitable for delivering quantities of a halogen as low as 0.1 $\mu$g or less may take the form of solid particles formed from a molten mixture of one or more metals and the halide of one or more metals. The metal halide component of the particle vaporizes during lamp operation to deliver the desired quantity of the halogen into the lamp. The metal halide in the particle must be soluble in the molten metal; however, it is undesirable to form two immiscible liquids or separate molten metal and solid metal halide phases.

Figure 1:
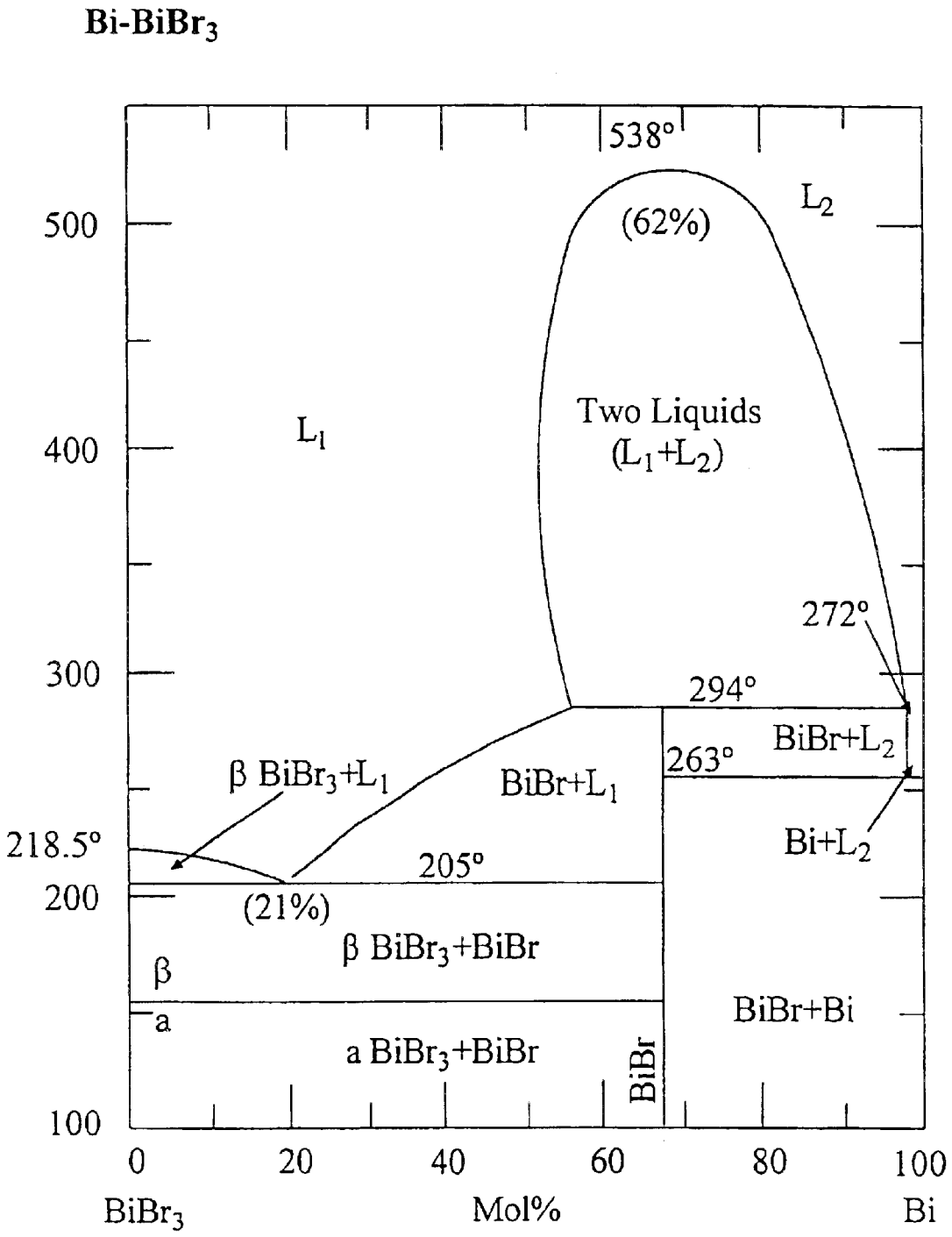
FIG. 1 is a phase diagram of the bismuth-bismuth bromide system.
Figure 2:
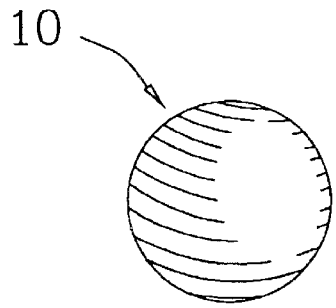
FIG. 2 is an illustration of a generally spherical particle according to one aspect of the present invention.
Figure 3:
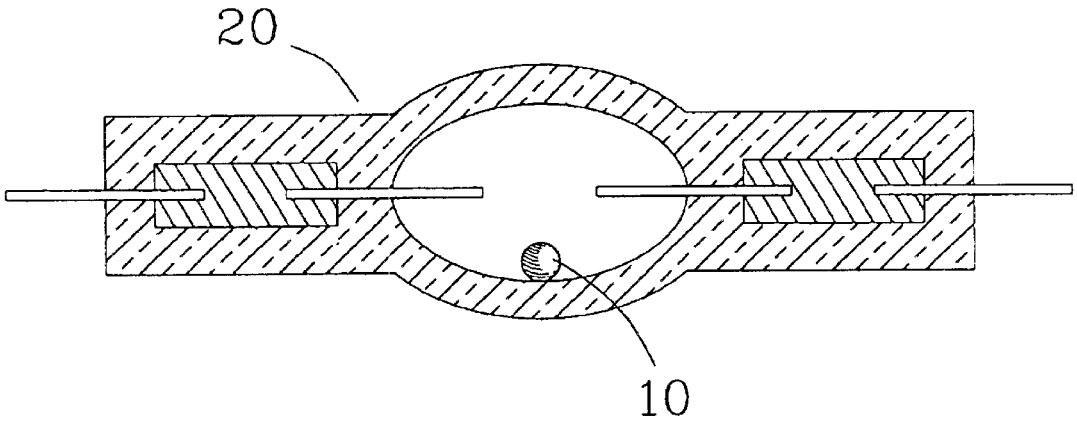
FIG. 3 is an illustration showing the generally spherical particle of FIG. 2 contained in the light-emitting chamber of an arc tube for an HID lamp.

It has been found that high solubility of metal halides in metals occurs in a limited number of systems. The metal halide may be dissolved in the parent metal of the metal halide as illustrated in the phase diagram for the bismuth-bismuth bromide system shown in FIG. 1. However, the metal halide may also be dissolved in the parent metal combined with one or more other metals, or with just one or more other metals. Some systems may provide mixtures comprising a low weight percent of the metal halide while other systems are suitable for providing mixtures comprising a low weight percent of the metal.

The particles may be formed by admixing the desired quantity of the halogen in the form of a metal halide with a molten metal and forming particles from the molten admixture. The amount of metal halide in the particle is limited by the solubility of the metal halide in the molten metal. The desired amount of metal in the particle is determined by the desire to have a particle large enough to facilitate handling and dosing, yet not too large so as to exceed the amount of metal which is tolerable within the arc tube of the lamp.

U.S. Pat. No. 3,676,534 to Anderson dated July, 1972 and assigned to the assignee of the present invention, the content of which is hereby incorporated by reference, discloses a process for forming uniformly sized particles of metal halide mixtures by forcing a homogeneous melt through an orifice of known diameter at a known velocity and acoustically or electromechanically breaking the molten jet into controlled lengths.

An alternative process is described in the Anderson U.S. Pat. No. 4,201,739 dated May, 1980 and assigned to the assignee of the present invention, the content of which is hereby incorporated by reference. In that Anderson patent, particles are formed by the controlled wetting of an orifice which allows the dripping of molten metal halide spheres of a larger diameter.

Particles suitable for dosing into the arc tube of a HID lamp are typically produced as spheres having an average diameter between about 50 and about 3,000 microns, and preferably between about 150 and about 1,200 microns. However, such particles may be produced in the dripping process described above with a diameter between about 1600 and about 3000 microns, preferably between about 1750 and about 2500 microns.

Examples of the metal and metal halide combinations suitable for forming lamp fill particles include:

A. metals from Group IIB, IIIA, IVA, and VA elements in combination with a halide of the metal, i.e., $M+MX_n$ where:
   - M is a metal from the group consisting of Bi, Cd, In, Sn, Tl, and Pb, and
   - $MX_n$ is a chloride, bromide, or iodide of the metal M (where n may be 1, 2, 3, 4, or 5);

B. metals from Group IIB, IIIA, IVA, and VA elements in combination with a halide of another metal from Group IIB, IIIA, IVA, and VA elements, i.e., $M'+M''X_n$ where:
   - M' is one or more metals from the group consisting of Bi, Cd, In, Sn, Tl, Pb, and Hg, and
   - $M''X_n$ is a chloride, bromide, or iodide of one or more metals from the same group as the metal M' (where n may be 1, 2, 3, 4, or 5).

C. alkali metal in combination with a halide of the alkali metal, i.e., M+MX—where M is a metal from the group consisting of Na, K, Rb, and Cs, and
   MX is a halide of the metal M;

D. alkaline earth metal in combination with a halide of the alkaline earth metal, i.e., $M+MX_n$ where:
   - M is a metal from the group consisting of Ca, Sr, and Ba, and
   - $MX_n$ is a metal halide of the metal M (where n is typically 2); and E. rare earth metals in combination with a halide of the rare earth metal, i.e., $M+MX_n$ where:
   - M is a metal from the group consisting of La and Ce and possibly Sc and Y and other lanthanides of atomic numbers 59–71, and
   - $MX_n$ is a chloride, bromide, or iodide of the metal M (where n is typically 3 but occasionally 2).

The most effective particles suitable as a lamp fill material for dosing small quantities of a halide in a lamp have been found to include a combination of one or more metals and a halide of one of more metals wherein the vapor pressure of the metal halide is relatively large, assuring the complete vaporization of the particle at the operating temperature of the lamp. The vapor pressure is preferably near (or larger than) the vapor pressure of the particular halide X of mercury, i.e., for a particle comprising $M+MX_n$, the vapor pressure of $MX_n$ is preferably near or larger than the vapor pressure of $HgX_2$.

The particles formed from the alkali metals, alkaline earth metals, and rare earth metals are less desirable than the others because of the halides of these metals have relatively low vapor pressures. Further, the reactivity of some of the metals in these groups may not be desirable for introduction into arc tubes formed from fused silica or for serving as an inert carrier for a metal halide. Thus the particles formed from the compositions described in groups A and B above may be the most effective in delivering small quantities of a halogen into a lamp. However, there may be some applications for particles formed from groups C, D, and E in ceramic arc tubes or in other applications where reactivity of the particle components is desired.

In the preferred embodiment of the present invention for delivering a small quantity of a halogen into an ultra high pressure mercury lamp, the particle is formed by dissolving bismuth bromide in molten bismuth metal.

EXAMPLE 1

A particle is formed by admixing 4 g BiBr3 with 96 g Bi metal, melting the admixture into a homogeneous melt, and solidifying the melt into a 1.0 mg particles having a composition of 4 weight percent $BiBr_3$ and 96 weight percent Bi metal. The particles formed are generally spherical and have a diameter of about 720 $\mu$m and a quantity of about 17 $\mu$g of bromine.

EXAMPLE 2

A particle is formed by admixing 10 g $BiBr_3$ with 90 g Bi metal, melting the admixture into a homogeneous melt, and solidifying the melt into 0.2 mg particles having a composition of 10 weight percent $BiBr_3$ and 90 weight percent Bi metal. The particles formed are generally spherical and have a diameter of about 350 $\mu$m and a quantity of about 8.6 $\mu$g of bromine.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. An arc tube for a HID lamp comprising:

a sealed arc tube envelope having a pair of electrodes spaced apart internally of said envelope and extending one each from opposing ends of said envelope;

a solid lamp fill material internally of said envelope, said material formed by dissolving a metal halide in a molten metal.

2. The arc tube of claim 1 wherein the metal is selected from the group consisting of Bi, Cd, In, Sn, Ti, Pb and Hg;

wherein the halide is selected from the group consisting of Cl, Br and I;

wherein the metal halide is less than about 50 micrograms;

wherein the metal is less than about 2 milligrams;

wherein the weight ratio of metal to metal halide is not less than about 10; and wherein the fill material comprises a particle that is a spheroid having a diameter between about 50 and 3,000 microns.

3. The are tube of claim 1 wherein the fill material comprises a particle having a diameter is between about 150 and about 1,200 microns or between about 1,750 and about 2,500 microns.

4. The arc tube of claim 1 wherein said metal is bismuth and said halide of said metal is bismuth bromide.

5. The arc tube of claim 1 wherein said fill material has an oxygen and hydrogen content less than 10 ppm and less than 1 ppm of contaminants which may promote devitrification of quartz.

6. A HID lamp comprising:

an outer envelope sealed to a mounting member at one end;

a sealed arc tube envelope mounted within said outer envelope, said arc tube envelope having a pair of electrodes spaced apart internally of said envelope and extending one each from opposing ends of said envelope through said base; and a solid lamp fill material internally of said envelope, said material formed by dissolving a metal halide within a molten metal and cooling the molten mixture.

7. A super high pressure mercury lamp having a small amount of bromine in the arc tube comprising:

an outer envelope sealed to a mounting member at one end;

a sealed arc tube envelope mounted within said outer envelope, said arc tube envelope being elongated and having a pair of electrodes spaced apart internally of said envelope and extending one each from opposite ends of said envelope through said base; and a lamp fill material internally of said arc tube envelope, said material having two components, one of said components comprising mercury and the other of said components comprising a particle formed by dissolving a metal halide in a molten metal.

* * * * *